US005971391A

United States Patent [19]

Salomon et al.

[11] Patent Number: 5,971,391

[45] **Date of Patent: *Oct. 26, 1999**

[54] NUDGER FOR A MAIL HANDLING SYSTEM

[75] Inventors: James A. Salomon, Cheshire; Eric Belec, Southbury; Steven E. Cohen, Seymour; Dennis C Inglesias, Portsmouth; Robert P. Rebres, Seymour; Anthony E Yap, Danbury, all of Conn.

[73] Assignee: Pitney Bowes Inc., Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/943,406

[22] Filed: Oct. 3, 1997

[51] Int. Cl.[6] ..... B65H 07/08

[52] U.S. Cl. ..... 271/153; 271/152; 271/155

[58] Field of Search ..... 271/31.1, 117, 271/126, 149, 150, 152, 153, 154, 155; 414/798.9

[56] References Cited

U.S. PATENT DOCUMENTS

| | | | |
|---|---|---|---|
| 3,981,493 | 9/1976 | Klappenecker et al. | 271/10 |
| 4,884,797 | 12/1989 | Suyatsky | 271/155 X |
| 4,919,412 | 4/1990 | Weigel et al. | 271/152 X |
| 4,930,764 | 6/1990 | Holbrook et al. | 271/119 |
| 4,955,596 | 9/1990 | Ricciardi | 271/152 X |
| 4,973,037 | 11/1990 | Holbrook | 271/2 |
| 5,074,540 | 12/1991 | Belec et al. | 271/34 |
| 5,092,574 | 3/1992 | Braen et al. | 271/2 |
| 5,116,039 | 5/1992 | Braen et al. | 271/34 |
| 5,415,386 | 5/1995 | Belec | 270/58 |

*Primary Examiner*—Janice L. Krizek
*Attorney, Agent, or Firm*—Steven J. Shapiro; Melvin J. Scolnick

[57] ABSTRACT

A nudger including apparatus for applying a feed force to a lead mailpiece of the stack of mixed mail to feed the lead mailpiece of the stack along a mailpiece feed path, the applying apparatus being moveable between first and second positions; structure for biasing the applying apparatus against a face of the lead mailpiece thereby generating a stack force against a stack of mixed mail; and a stack advance mechanism for moving the stack of mixed mail so that the face of the lead mailpiece contacts the applying apparatus; wherein at times when the applying apparatus is in the first position the stack advance mechanism moves the stack of mixed mail in the direction of the applying apparatus causing the applying apparatus to move from the first position to the second position against the biasing structure such that the stack force increases causing a corresponding increase in the feed force; and further wherein at times when the applying apparatus is in the second position the stack advance mechanism stops moving the stack of mixed mail and the applying apparatus continuously feeds mailpieces away from the stack of mixed mail along the mailpiece feed path thereby continuously reducing the size of the stack of mixed mail so that the biasing structure gradually moves the applying apparatus from the second position to the first position and the stack force gradually decreases during movement of the applying apparatus from the second position to the first position.

8 Claims, 8 Drawing Sheets

10
11
17
19
21
23
25
27
13a
1
A
13
15
7
5
63
65
29
3
38
3a
39
37
40
31
51
33
49
71
75
41
43
50
53
55
45
57
59
73
66
9
TO 41
TO 29
61
67

NUDGER FOR A MAIL HANDLING SYSTEM

BACKGROUND

The processing and handling of mailpieces consumes an enormous amount of human and financial resources, particularly if the processing of the mailpieces is done manually. The processing and handling of mailpieces not only takes place at the Postal Service, but also occurs at each and every business or other site where communication via the mail delivery system is utilized. That is, various pieces of mail generated by a plurality of departments and individuals within a company need to be collected, sorted, addressed, and franked as part of the outgoing mail process. Additionally, incoming mail needs to be collected and sorted efficiently to ensure that it gets to the addressee in a minimal amount of time. Since much of the documentation and information being conveyed through the mail system is critical in nature relative to the success of a business, it is imperative that the processing and handling of both the incoming and outgoing mailpieces be done efficiently and reliably so as not to negatively impact the functioning of the business.

In view of the above, various automated mail handling machines have been developed for processing mail (removing individual pieces of mail from a stack and performing subsequent actions on each individual piece of mail). However, in order for these automatic mail handling machines to be effective, they must process and handle "mixed mail." The term "mixed mail" is used herein to mean sets of intermixed mailpieces of varying size, thickness, and weight. In addition, the term "mixed mail" also includes stepped mail (i.e. an envelope containing therein an insert which is smaller than the envelope to create a step in the envelope), tabbed and untabbed mail products, and mailpieces made from different substrates. Thus, the range of types and sizes of mailpieces which must be processed is extremely broad and often requires trade-offs to be made in the design of mixed mail feeding devices in order to permit effective and reliable processing of a wide variety of mixed mailpieces.

In known mixed mail handling machines which separate and transport individual pieces of mail away from a stack of mixed mail, the stack of "mixed mail" is first loaded onto some type of conveying system for subsequent sorting into individual pieces. The stack of mixed mail is moved as a stack by an external force to, for example, a shingling device. The shingling device applies a force to the lead mailpiece in the stack to initiate the separation of the lead mailpiece from the rest of the stack by shingling it slightly relative to the stack. The shingled mailpieces are then transported downstream to, for example, a separating device which completes the separation of the lead mailpiece from the stack so that individual pieces of mail are transported further downstream for subsequent processing. In the mailing machine described immediately above, the various forces acting on the mailpieces in moving the stack, shingling the mailpieces, separating the mailpieces and moving the individual mailpieces downstream often act in a counterproductive manner relative to each other. For example, inter-document stack forces exist between each of the mailpieces that are in contact with each other in the stack. The inter-document stack forces are created by the stack advance mechanism, the frictional forces between the documents, and potentially electrostatic forces that may exist between the documents. The inter-document forces tend to oppose the force required to shear the lead mailpiece from the stack.

Additionally, the interaction of the force used to drive the shingled stack toward the separator and the forces at the separator can potentially cause a thin mailpiece to be damaged by being buckled as it enters the separator. Furthermore, in a conventional separator, there are retard belts and feeder belts that are used to separate the mailpiece from the shingled stack. Both the forces applied by the retard belts and the feeder belts must be sufficient to overcome the inter-document forces previously discussed. However, the force of the retard belts cannot be greater than the force of the feeder belts or the mailpieces will not be effectively separated and fed downstream to another mail processing device. Moreover, if the feeding force being applied to the mailpieces for presenting them to the separator is too great, another potential problem which may occur is that a plurality of mailpieces will be forced through the separator without the successful separation of the mailpieces.

In view of the above, it is recognized that large forces are desirable to act on the mailpieces to accelerate and separate the mailpieces in a reliable and efficient manner. However, these same high forces can damage the mailpieces being processed (i.e. buckled lightweight mailpieces). Conversely, if the forces used to accelerate and separate the mailpieces are too small, poor separation, a lower throughput, and stalling of the mailpieces being processed will result. Put in another way, thin mailpieces are weak and require low forces to prevent them from being damaged, while thick/heavy mail is strong and requires high forces for proper separation and feeding. Thus, the structure used to separate a stack of mixed mail must take into account the counterproductive nature of the forces acting on the mailpieces and be such that an effective force profile acts on the mailpieces throughout their processing cycle so that effective and reliable mailpiece separation and transport at very high processing speeds (such as four mailpieces per second) can be accomplished without physical damage occurring to the mailpieces. However, since the desired force profile acting on a particular mailpiece is dependent upon the size, thickness, configuration, weight, and substrate of the individual mailpiece being processed, the design of a mixed mail feeder which can efficiently and reliably process a wide range of different types of mixed mailpieces has been extremely difficult to achieve.

SUMMARY OF THE INVENTION

It is an object of the invention to provide a nudger for a mail handling system which is effective in processing mixed mail from a stack of mixed mail. The above object is met by providing a nudger including apparatus for applying a feed force to a lead mailpiece of the stack of mixed mail to feed the lead mailpiece of the stack along a mailpiece feed path, the applying apparatus being moveable between first and second positions; structure for biasing the applying apparatus against a face of the lead mailpiece thereby generating a tack force against a stack of mixed mail; and a stack advance mechanism for moving the stack of mixed mail so that the face of the lead mailpiece contacts the applying apparatus; wherein at times when the applying apparatus is in the first position the stack advance mechanism moves the stack of mixed mail in the direction of the applying apparatus causing the applying apparatus to move from the first position to the second position against the biasing means such that the stack force increases causing a corresponding increase in the feed force; and further wherein at times when the applying apparatus is in the second position the stack advance mechanism stops moving the stack of mixed mail and the applying apparatus continuously feeds mailpieces away from the stack of mixed mail along the mailpiece feed path thereby continuously reducing the size of the stack of mixed mail so that the biasing structure gradually moves the applying apparatus from the second position to the first position and the stack force gradually decreases during movement of the applying apparatus from the second position to the first position.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
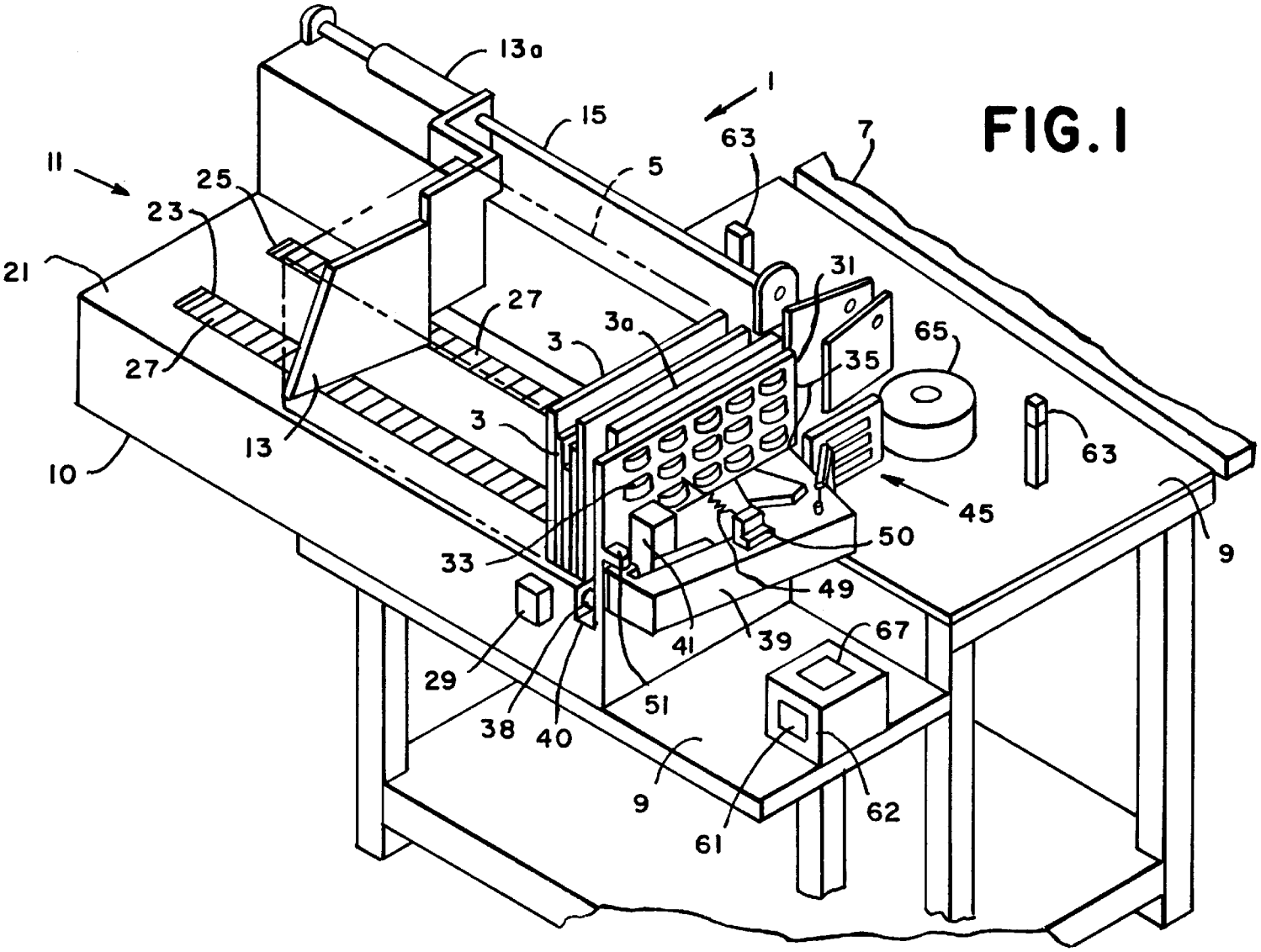
FIG. 1 is a perspective view of the inventive mail handling machine.
Figure 2:
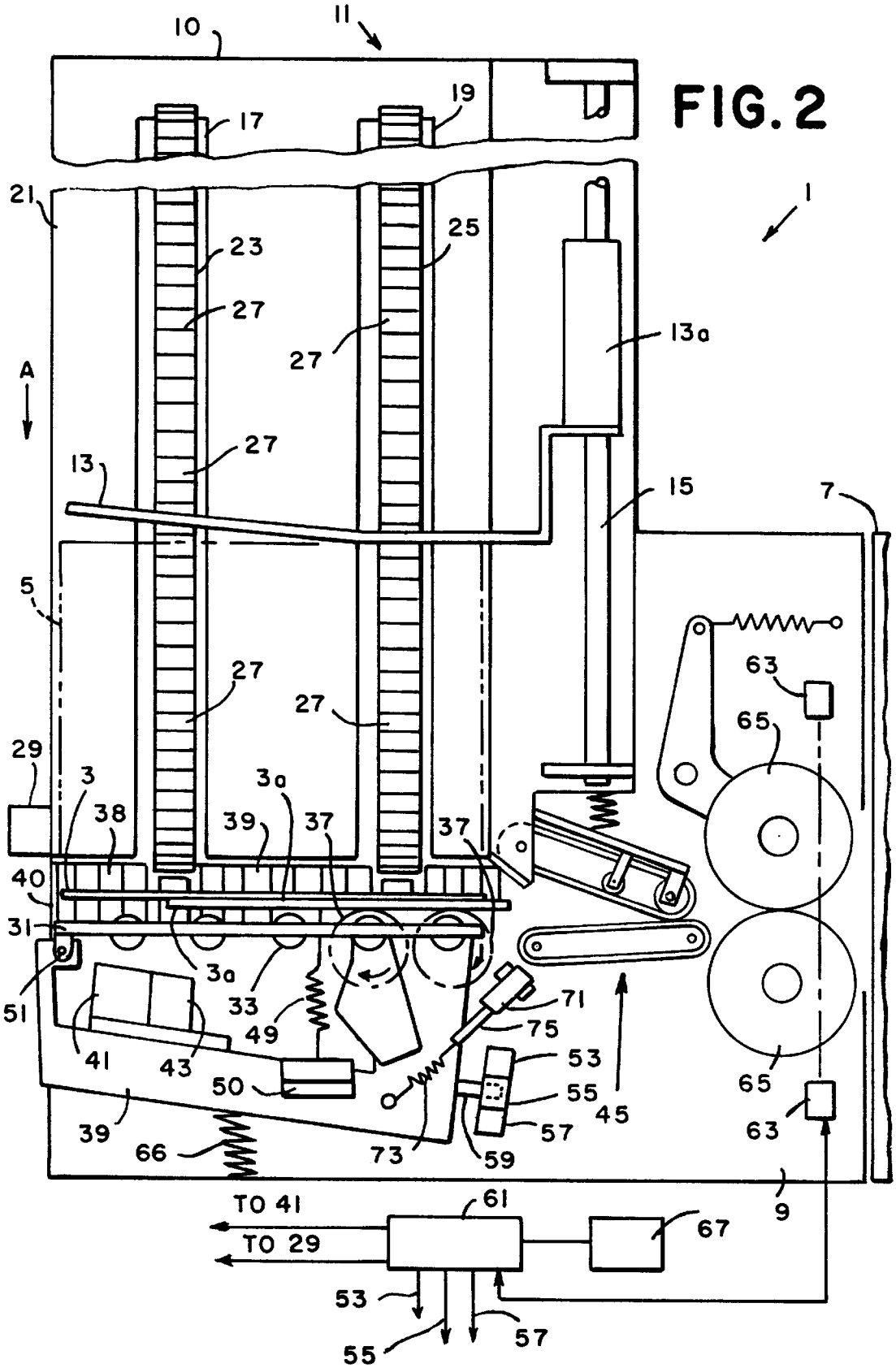
FIG. 2 is an enlarged plan view of FIG. 1.

Referring to FIGS. 1 and 2, a mixed mail feeder 1 is shown. Mixed mail feeder 1, as will be discussed in more detail below, separates individual mailpieces 3 from a stack of mixed mail generally designated at 5 and transports the individual mailpieces 3 to a subsequent mail processing station 7. Mail processing station 7 can be any one of a plurality of devices such as a meter for printing postage on the mailpiece 3, an OCR reader for reading addresses off of the mailpiece 3, a sorting device for sorting the individual mailpieces 3 to designated bins or areas, or even a scale that weighs the mailpiece. The key point is that the mixed mail feeder 1 functions to separate individual mailpieces 3 from a stack of mixed mail 5 and deliver the individual mailpieces 3 sequentially to the mail processing station 7.

Mixed mail feeder 1 includes a table 9 upon which all of the components of the mixed mail feeder 1 are mounted. At an input end of the mixed mail feeder 1, generally designated by the arrow 11, the stack of mixed mail 5 is placed on edge by an operator in front of a guide wall 13. Guide wall 13 acts as a support against which the stack of mixed mail 5 rests. Moreover, guide wall 13 includes a cylindrical portion 13*a* which is mounted to slide on a guide rod 15 fixedly attached to platform 10 which is mounted to table 9.

Platform 10 has first and second slots 17, 19, in a horizontal surface 21 thereof. The slots 17, 19 each permit a top portion of a respective individual continuous belt 23, 25 to project therethrough. Belts 23, 25 each have a plurality of individual track portions 27 over the full extent of the belts 23, 25. The bottom of guide wall 13 removably fits in adjacent track portions 27 of each of belts 23 and 25 so that guide wall 13 moves with belts 23, 25 in the direction of arrow A (alternatively, a single belt can be used). Moreover, as guide wall 13 moves in the direction of arrow A with the belts 23, 25, the cylindrical portion 13*a* slides along guide rod 15 to keep the standing orientation of guide wall 13 in the position shown in FIG. 1.

Continuous belts 23, 25 are mounted in a conventional manner around a pulley at each end (not shown). One pulley is an idler pulley while the other is driven by a motor 29. The motor 29 drives a common shaft (not shown) connected to the drive pulleys of each of the belts 23, 25 such that the belts 23, 25 will be driven at the same velocity to move around their respective idler and driven pulleys. Thus, as the belts 23, 25 move around the pulleys in the direction of arrow A, the guide wall 13 moves therewith so that the entire stack of mixed mail 5 is moved toward a nudger wall 31. As will be discussed in more detail below, the stack of mixed mail 5 will have individual mailpieces 3 moved from the stack downstream so that the stack of mixed mailpieces is continuously reduced in size. When the guide wall 13 has been moved to a point where it is desirable to add additional pieces of mixed mail to the stack, the guide wall 13 can be lifted out of the individual tracks 27 of the belts 23, 25 by pulling the guide wall 13 up to rotate, via the cylindrical portion 13*a*, about the guide rod 15. Once the bottom of the guide wall 13 is clear of the individual tracks 27 of the belts 23, 25, it can be slid backward in the opposite direction from that of arrow A and placed in a desired position to receive additional mixed mail.

Figure 3:
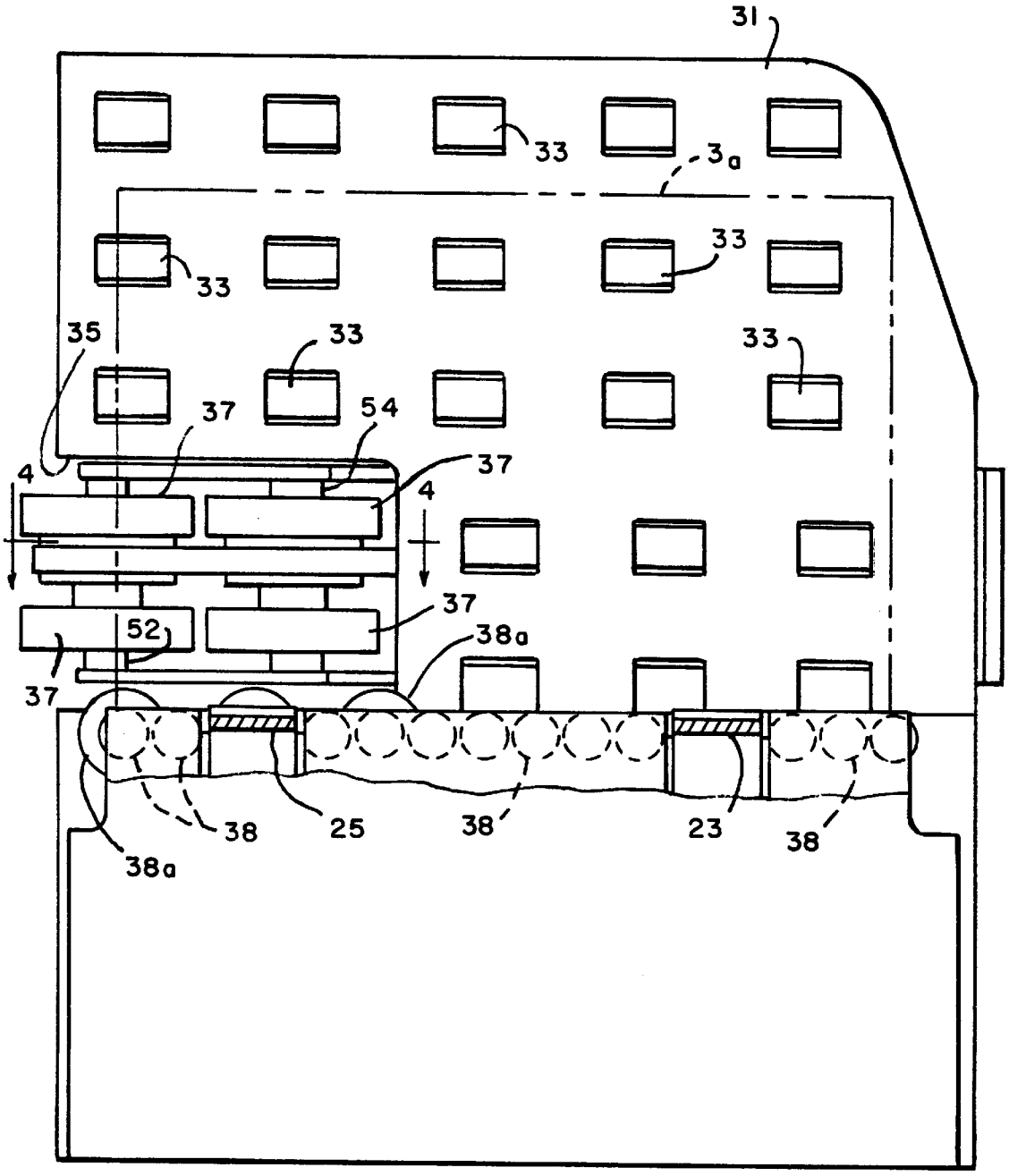
FIG. 3 is an enlarged detailed view of the nudger wall of FIG. 1.

Referring to FIGS. 1, 2, and 3, nudger wall 31 includes a plurality of rollers 33 mounted therein in a conventional manner to be freely rotatable. Furthermore, nudger wall 31 has a cutout 35 in a lower corner thereof through which driven nudger rollers 37 project. Moreover, a plurality of roller bars 38 are rotatably mounted in a conventional manner in a slot 40 of platform 10. Thus, as guide wall 13 pushes the stack of mixed mail 5 toward nudger wall 31, individual pieces of mail 3 fall off the end of belts 23, 25 on top of the rollers 38 and into contact with the nudger rollers 37. While in the preferred embodiment the roller bars 38 are not driven, they could be driven to provide additional forward feed force to the mailpiece 3. In one embodiment, a continuous belt (not shown) is driven around the roller bars 38. The use of the continuous belt provides a greater coefficient of friction as compared to the roller bars and thus improves the feed force and provides for a simple drive structure.

Figure 4:
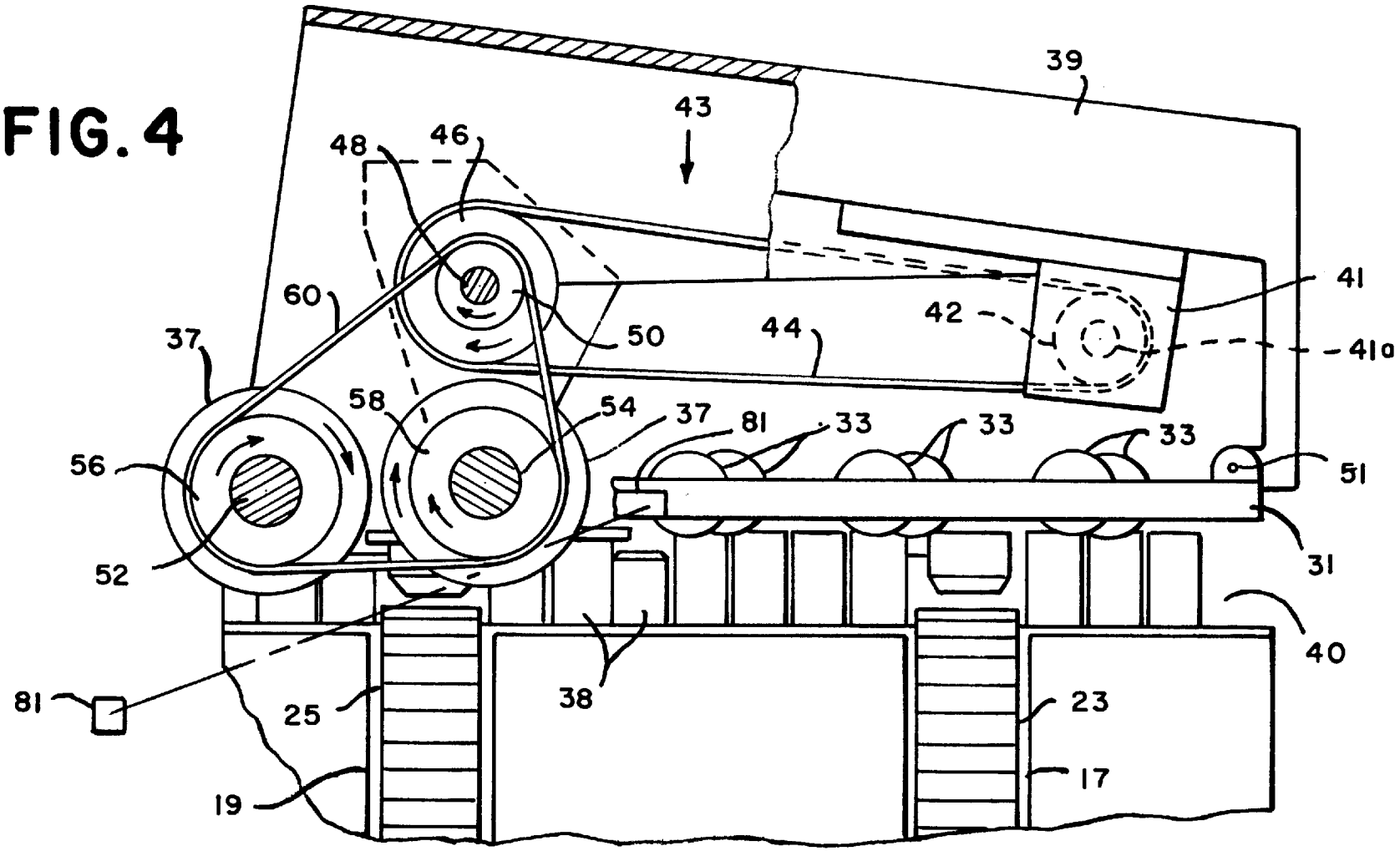
FIG. 4 is an enlarged top plan view partially in section along line 4—4 of FIG. 3 showing details of the nudger roller drive system.

The nudger rollers 37 are mounted to be driven into rotation within a nudger arm 39. The four nudger rollers 37 are driven together by a motor 41, mounted on nudger arm 39, via a drive train 43 as shown schematically in FIG. 2 and in detail in FIG. 4. As shown in FIGS. 2 and 4, all of the nudger rollers 37 are driven into rotation in a clockwise direction. Accordingly, as the stack of mixed mail 5 is moved toward nudger wall 31, the lead mailpiece 3*a* is forced into contact with the nudger rollers 37. The force of the driven nudger rollers 37 acts against the lead mailpiece 3*a* to move the mailpiece 3*a* in the direction of a conventional separator device 45, thereby shingling the lead mailpiece 3*a* from the stack of mixed mail 5 as shown in FIGS. 1 and 2. The shingled stack is then transported to the nip of separator 45 which operates in a conventional manner to separate the lead mailpiece 3*a* from the shingled stack and deliver it to take-away rollers 65 which transport the individual lead mailpiece 3*a* further downstream to mail processing station 7.

Referring to FIGS. 3 and 4, the details of the drive system 43 are shown. Motor 41 has a shaft 41*a* connected to a pulley 42. A continuous belt 44 is disposed around pulley 42 and a second pulley 46. Pulley 46 is fixedly mounted to a rotatable shaft 48 mounted in nudger arm 39. Also, fixedly mounted to shaft 48 is a third pulley 50. Additional shafts 52, 54 are also rotatably mounted in nudger arm 39 and respectively have fourth and fifth pulleys 56, 58 fixedly mounted thereto. Nudger rollers 37 are mounted on a corresponding one of shafts 52, 54. Accordingly, as motor 41 rotates pulley 42 in the clockwise direction of FIG. 4, pulley 46 and hub 48 are driven in the clockwise direction as well. Since a continuous belt 60 passes around pulleys 50, 56, and 58, shafts 52, 54 are forced to rotate in the clockwise direction causing a corresponding rotational movement in all of nudger rollers 37.

In order for the nudger rollers 37 to effectively feed the stack of mixed mail into the separator 45, accurate control of the normal force applied to the stack of mixed mail 5 by the interaction of the guide wall 13 and the nudger rollers 37 needs to be achieved. The normal force is created by a spring 49 that is fixedly mounted at one end to the nudger wall 31 and at its other end to a mounting platform 50 of nudger arm 39. The nudger arm 39 is pivotally mounted about a conventional pivot structure 51 so that the spring 49 biases the nudger rollers 37 through the cutout 35 and into contact with the lead mailpiece 3*a*. Thus, as the guide wall 13 is advanced in the direction of the nudger wall 31, the nudger arm 39 is forced to rotate in the clockwise direction of FIG. 2 around pivot structure 51 in opposition to the biasing force of the spring 49. As the spring 49 is extended due to the rotation of nudger arm 39 about the pivot structure 51, the force exerted by the spring 49 is continually increased by a known amount.

As discussed above, it is desirable to regulate the amount of normal force being exerted by the spring 49, via the nudger rollers 37, on the stack of mixed mailpieces 5 to ensure that only the minimal amount of normal force required to permit the nudger rollers 37 to move each of the mixed mailpieces 3 toward the separator 45 is applied. That is, it is not desirable to continuously run motor 29 to constantly advance the guide wall 13 toward the nudger wall 31. If this occurs, spring 49 will be extended to a length that applies too great a normal force on the lead mailpiece 3*a*. While this greater normal force may be acceptable for feeding heavier mailpieces 3 toward the separator 45, it can create a significant problem for very thin mailpieces and untabbed mailpieces. That is, as the thin and untabbed mailpieces are fed by the nudger rollers 37 into the separator 45, they can easily be buckled and damaged due to the feeding force of the nudger rollers 37 and the forces exerted by separator 45. Additionally, if the guide wall 13 is advanced too far toward the nudger wall 31 the stack of mixed mail 5 will be clamped in place preventing the feeding of individual mailpieces from stack 5. To prevent this from happening, the contact point of the nudger rollers 37 against the lead mailpiece 3*a* is always maintained closer to the stack 5 than the facing surface of the nudger wall 31 is to the stack 5. This is accomplished by ensuring that the rotation of arm 39 is controlled (as discussed in more detail below) so that the contact point of the nudger rollers 37 against the mailpieces occurs between 7 to 16 millimeters away from guide wall 31 (contact point of rollers 37 extends beyond wall 31 in this range). This configuration permits the guide wall 31 to provide support to large mailpieces while at the same time it does not provide a surface at which the mailpieces can be clamped in place. Correspondingly, if the guide wall 13 is not advanced sufficiently enough toward nudger wall 31, the spring 49 will only be extended to provide a very small normal stack force. If this force is too small, the action of the driven rotating nudger rollers 37 on the lead mailpiece 3*a* will be insufficient to overcome the inter-document forces existing between individual pieces of the stack of mixed mail 5 such that the shingling of the mailpieces 3 and the advancement of the shingled stack toward separator 45 will not occur and a stalled condition at nudger wall 31 occurs. Thus, as described above, the normal force which is created by the positioning of the mailpiece stack 5 against the nudger rollers 37 and the corresponding force created by the extension of spring 49 needs to be maintained in a range of 1–2 newtons in order to ensure that the various types of mixed mailpieces 3 which may be processed are properly shingled and fed vertically into the throat of separator 45 without being damaged or stalled at nudger wall 31.

Since the normal force is provided by the extension of spring 49, it can be controlled by accurately regulating the position of nudger arm 39 which correspondingly regulates the extension of spring 49. That is, since the normal force applied by spring 49 is directly proportional to its extension, the normal force that it applies to the stack of mixed mail 5 is controlled by regulating the extension of spring 49.

The aforementioned control of the extension of spring 49 and rotation of nudger arm 39 is accomplished via the utilization of conventional through-beam sensors 53, 55, and 57 and a finger 59 which projects from nudger arm 39. As nudger arm 39 rotates about pivot structure 51, the finger 59 will move between the three sensors 53, 55 and 57. When finger 59 blocks an individual one of the through-beam sensors 53, 55, and 57, a signal is sent by the respective blocked through-beam sensor to a mixed mail feeder microprocessor 61 indicating the position of the finger 59 at the blocked sensor. The known position of the finger 59 corresponds to a known position of the nudger arm 39 and a known amount of extension of the spring 49. Thus, at any of the positions where the finger 59 blocks one of the sensors 53, 55, and 57, the exact normal force being applied by spring 49 through the nudger rollers 37 on the stack of mail 5 is known.

If the finger 59 is blocking the beam of the first sensor 53, the microprocessor 61 knows that the nudger rollers 37 are at their innermost position relative to the stack of mixed mail 5. At this position, the normal force exerted by spring 49 is below the desired minimum value of 1 newton and must be increased. The increase in normal force is created when the microprocessor 61, in response to a signal from sensor 53, energizes the motor 29 to move the belts 23 and 25 such that the guide wall 13 advances the mixed mail stack 5 into the nudger rollers 37. The motor 29 will advance the stack of mixed mail 5 until the nudger arm 39 pivots about pivot structure 51 to the position where finger 59 blocks the through-beam sensor 55. When this occurs, the sensor 55 sends a signal to microprocessor 61 which in turn deenergizes motor 29 stopping the advance of the stack of mixed mail 5 toward the nudger rollers 37. In this position, the nudger rollers 37 are considered to be in the "out" position where the maximum desired normal force is being exerted on the lead mailpiece 3*a* due to the extension of the spring 49. Subsequently, as mail is fed from the stack of mixed mail 5 toward the separator 45 due to the action of the rotating nudger rollers 37, the nudger rollers 37 gradually move toward the innermost normal force position. When the nudger arm 39 has rotated inwardly such that the nudger rollers 37 are in the innermost normal force position, microprocessor 61 receives a signal from sensor 53 and energizes motor 29 to advance the stack of mail 5 until the second sensor 55 is blocked by the finger 59. In this manner, constant regulation of the normal force in the predetermined range is maintained.

In a first preferred embodiment, the automatic control of the normal force, as described above, would only use the sensors 53 and 55 to ensure that the normal force generated by the nudger rollers 37 stays within the predetermined desired normal force range. However, in a second preferred embodiment, a second tier of additional stack force can be applied if it is determined that a mailpiece 3 has stalled at the nudger rollers 37 or at the separator 45. That is, it is possible, since the mixed mail feeder 1 is designed to handle many different types of mixed mail, that a very heavy piece of mail may have stalled (become stuck) at the nudger rollers 37 or separator 45. This situation would occur when the normal force applied by the nudger rollers 37 is insufficient to shingle the heavier mailpieces from the stack of mixed mail 5 and move the shingled stack downstream into the nip of the separator 45. If stalling occurs, the mixed mail feeder 1 is essentially in a jammed or inoperative position. The way in which the mixed mail feeder 1 determines that a stall has occurred is by the use of a through-beam sensor 63, which is positioned proximate to the nip of takeaway rollers 65. Takeaway rollers 65, in a conventional manner, receive individual mailpieces from separator 45 and move the individual mailpieces 3 downstream. Thus, if the takeaway rollers 65 feed a first mailpiece and do not process a second mailpiece 3 downstream in a predetermined period of time of, for example, 1,000 msec, the through-beam of sensor 63 does not detect the lead edge of the second mailpiece during that same predetermined time period. If the microprocessor 61 does not receive an indication from the sensor 63 that a leading edge of the second mailpiece has passed thereby within the predetermine period of time, microprocessor 61 is programmed to assume that a stall has occurred somewhere upstream. Microprocessor 61 then energizes motor 29 to cause the stack of mixed mail 5 to be moved toward the nudger wall 31. The nudger arm 39 is forced to rotate about the pivot point 51 and the spring 49 is further extended. Motor 29 is driven until nudger arm 39 is advanced to block the third sensor 57. In this position, a stalled normal force, which is larger than the maximum normal force applied under normal operating conditions, is being exerted on the lead mailpiece 3*a* by the nudger rollers 37 and the motor 29 is rendered inoperative by microprocessor 61. The increased normal force can simply be due to the further extension of the spring 49 as the nudger arm 39 is rotated from its position blocking sensor 55 to its position blocking sensor 57, or can be further increased by the force of an additional compression spring 66 which only contacts the nudger arm 39 to provide an additional spring force thereto when the nudger arm 39 moves beyond the position from the blocking of sensor 55 toward the blocking of sensor 57. Assuming that the additional normal force applied is sufficient to move the stalled mailpiece 3, the takeaway sensor 63 will provide an input to the microprocessor 61 identifying that the lead edge of the stalled mailpiece has passed thereby and the processing of individual mailpieces 3 will continue by driving the nudger rollers 37 until the nudger arm 39 moves to a position where the first sensor 53 is blocked by finger 59. At this position, the system will operate as discussed above, regulating a force profile by maintaining the position of nudger arm 39 between the sensors 53 and 55. In the event however, that even the additional normal force provided by the movement of the nudger arm 39 to block the sensor 57 does not correct the stalled problem, the microprocessor 61, after a predetermined period of time, will provide an input to the user via a display 67 identifying the stalled condition and advising that operator intervention is required to correct the problem. As is readily apparent to one skilled in the art, the microprocessor 61 controls all of the motors typically associated with the stack advance, shingling device, separator, and take away rollers and includes known clock structure for determining the predetermined time periods discussed above. Empirical testing has shown that for the anticipated mixed mailpiece profile the additional normal force applied during movement of finger 59 from sensor 55 to sensor 57 goes from 2 to 5 newtons. Preferably, the spring 66 is selected and preloaded so that upon initial engagement with arm 39 the total normal force immediately goes to 4 newtons.

In yet another embodiment of the invention, a different mechanism is used to provide additional force in the situation where stalled mail is detected. That is, once the microprocessor 61 determines that a stall has occurred, utilization of a solenoid 71 and another spring 73 provides additional normal force in an attempt to overcome the stalled situation. The solenoid 71 is fixedly mounted to the platform 9 and the spring 73 has one end fixedly mounted to the nudger arm 39 and a second end fixedly mounted to a moveable plunger 75 of solenoid 71. When the nudger arm 39 is positioned in the normal force operating range, the spring 73 is slack, thereby providing no additional normal spring force. However, when stalled mail is detected, the microprocessor 61 energizes the solenoid 71 to withdraw the plunger 75 such that the spring 73 is extended to provide an additional normal force to the mixed mail stack 5 via the nudger rollers 37. The force applied by the solenoid/spring combination 71/73 can be consistently applied for a predetermined period of time or can be pulsed to help the stalled mail break away. Moreover, in a more complex arrangement, different levels of force can be applied by the spring 73 and solenoid 71 combination over a predetermined time period in an attempt to break the stalled mailpiece away. The gradual application of increased forces has the benefit of not immediately providing too great a force to the stalled mailpiece, which force could potentially damage the piece of mail if it is too great. The advantages of using the solenoid/spring 71/73 combination is that, unlike the previously described embodiments, the application of the additional force does not depend on the stack advance response time such that the stalled mail situation is corrected faster thereby improving the overall throughput of the mixed mail feeder. Additionally, the use of the solenoid/spring 71/73 combination reduces the range of nudger roller 37 motion, thereby directing the trajectory of the mail at the feeder closer to the optimum area. Finally, while FIG. 2 shows each of the springs 49, 66 and 73, each of these springs either alone or in combination can be used to provide the desired normal force.

Figure 5:
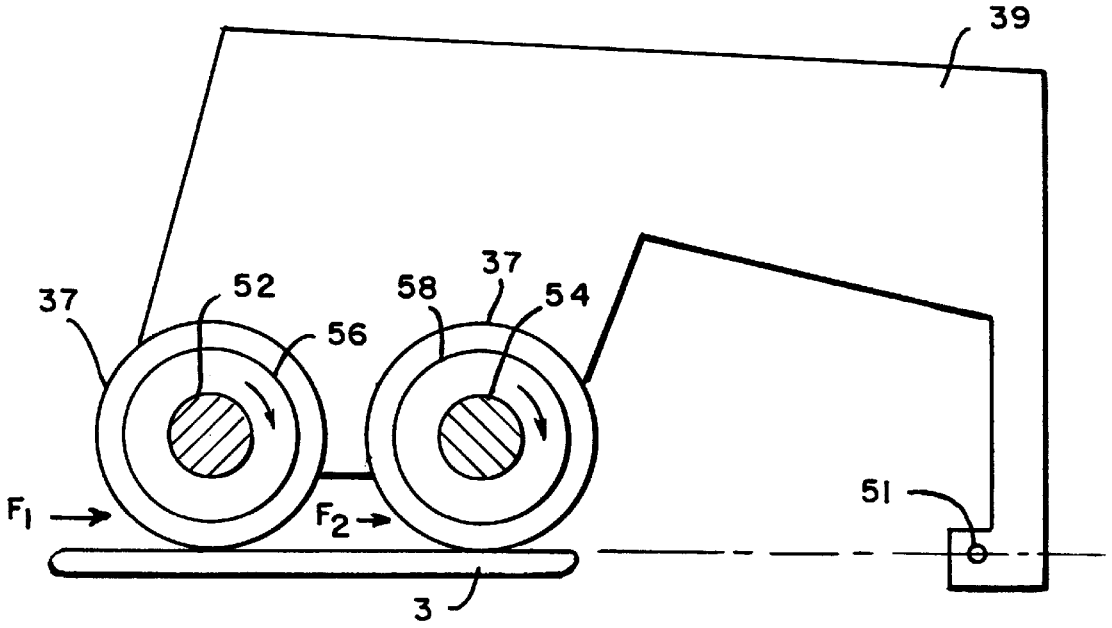
FIG. 5 is a schematic view of the reaction forces associated with the nudger arm, nudger rollers and mailpiece.

In yet another embodiment of the invention, a more simplified mechanism for providing an increased normal force on the stack of mixed mail 5 is to offset the pivot of the nudger arm 39 so that the reaction force between the mail and the nudger rollers 37 pulls the nudger arm 39 against the mailpieces 3, thereby providing additional stack force. This embodiment is best explained by first referring to FIG. 5 which schematically shows the relationship of nudger rollers 37 to the pivot point 51 of nudger arm 39 in the embodiment of FIGS. 1 and 2. As shown, when nudger rollers 37 are driven, reaction forces $F_1$ and $F_2$ are respectively created due to the coefficient of friction between the nudger rollers 37 and the mailpiece 3. Since these forces $F_1$, $F_2$ pass through the pivot point 51 of nudger arm 39, they do not create a moment about pivot point 51 and thus do not affect the normal stack force as nudger arm 39 rotates. However, if the structure of FIG. 5 is changed as reflected in FIG. 6, effective use of the reaction forces $F_1$ and $F_2$ can be made to automatically increase the normal force acting on the stack as the nudger rollers 37 move inboard toward the stack of mixed mail 5 as compared to the embodiment of FIG. 5.

Figure 6:
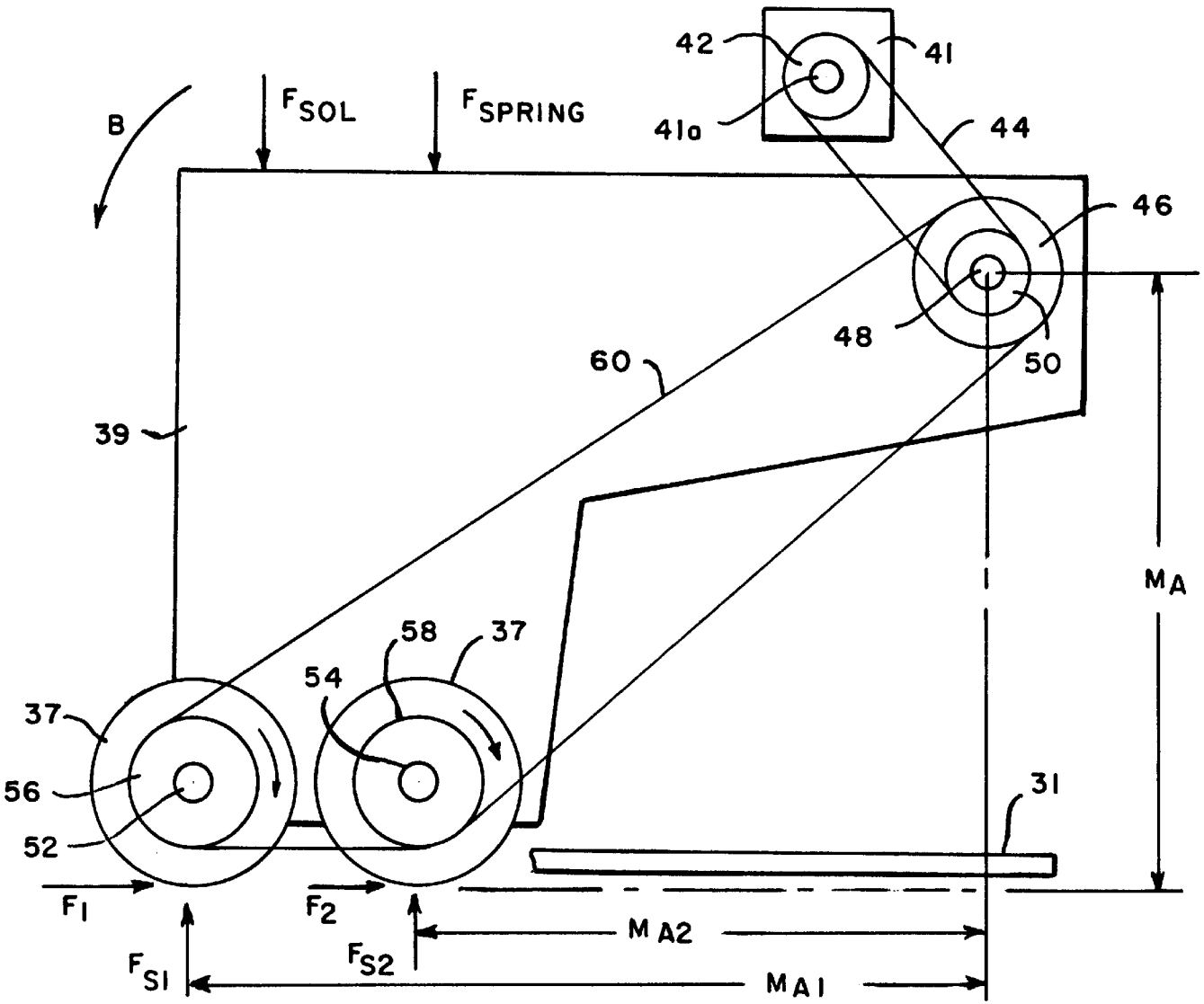
FIG. 6 is a second embodiment of the nudger arm, nudger rollers, and mailpiece orientation which utilizes the reaction forces between the nudger rollers and the mailpiece to drive the nudger arm into the mailpiece.

In FIG. 6, motor 41 is no longer mounted on nudger arm 39 but is fixedly mounted to table 9 (not shown). The remaining structure of the nudger roller 37 drive system is the same as described in connection with FIG. 4. However, in FIG. 6, nudger arm 39 is mounted to pivot along the rotational axis of shaft 48. The rotational axis of shaft 48 is located a distance "$M_A$" from the direction of the reaction forces $F_1$ and $F_2$ such that respective moments "$F_1M_2$" and "$F_1M_2$" "are created about the pivot axis of shaft 48. Since the sum of the moments about the axis of shaft 48 is equal to zero, the following equation results.

$$M_A\times(F_1+F_2)+M_{ASPRING}\times F_{SPRING}+M_{ASOLENOID}\times F_{SOLENOID}= M_AF_{S1}+M_AF_{S2}+MOTOR\ DRIVE\ TORQUE$$

From the above equation, as nudger arm 39 rotates inwardly along arrow "B", the moment arms of the spring 49, solenoid/spring 71/73, and normal forces $F_{s1}$ and $F_{s2}$ decrease while the moment arm of the reaction forces $F_1$, $F_2$ increase. In the system of FIG. 5, $M_A\times F_1\times F_2$ is zero and thus as the nudger arm rotates $F_{s1}$ and $F_2$ decrease. However, in the structure of FIG. 6, the increased $M_A$ of $F_1$ and $F_2$ creates a larger moment about the axis of shaft 48 so that the stack forces $F_1$ and $F_2$, at any point during the inward rotation of nudger arm 39, are greater than the corresponding stack forces at the same rotational position of the nudger arm 39 of FIG. 5. Thus, additional stack force has been created in the embodiment of FIG. 6 by utilizing the reaction force between the nudger rollers 37 and mailpiece 3. This apparatus requires no additional structure as compared to the FIG. 5 configuration and is automatically applied as nudger arm 37 moves. Moreover, since the reaction forces are dependent upon the coefficient of friction of the mailpiece 3, the increased stack force varies depending on the coefficient of friction of the mailpiece 3. It is important to not that one possessing ordinary skill in the art utilizing the instant disclosure can balance the spring design, the drive ratio, and the arm 39 geometry relative to the pivot point thereof to ensure the stack force applied during the full range of motion of arm 39 falls within a desired range.

Figure 7:
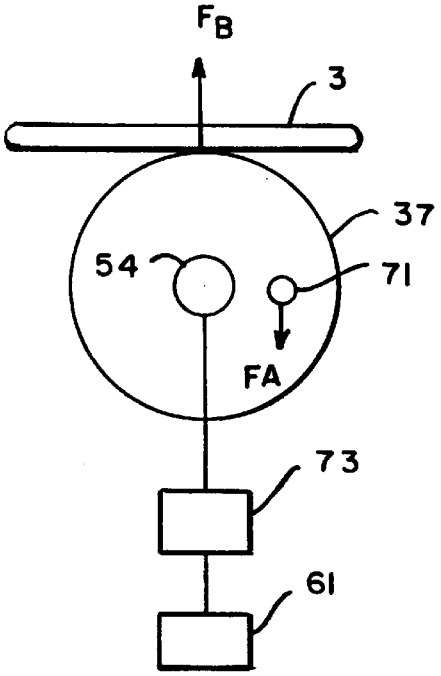
FIG. 7 shows a third embodiment of a nudger system.

Yet another way to provide an increased stack force on demand is to have a rotating imbalance on the nudger rollers 37. That is, with reference to FIG. 7, each nudger roller 37 has an offset center of gravity (CG) 71. When the position of CG 71 is as shown in FIG. 7, microprocessor 61 controls motor 41 to accelerate the nudger rollers 37. The acceleration of the CG 71 results in a force $F_A$ and a corresponding increased stack force $F_B$. A conventional encoder 73 operatively associated with shaft 54 provides signals to motor 61 indicative of the position of shaft 54 and thus of CG 71. By timing the acceleration of the nudger rollers 37 properly, the acceleration of CG 71 provides more force into the stack and less force off the stack. This structure can be used in connection with sensor 63 to provide an increased pulsed stack force when a stall is detected.

Figure 8:
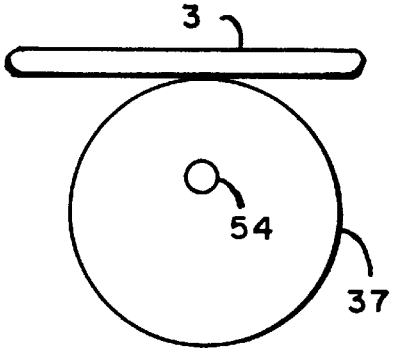
FIG. 8 shows a fourth embodiment of a nudger system.

Along similar lines, as shown in FIG. 8, nudger rollers 37 can be mounted for eccentric rotation thereby using the reaction of the eccentric rollers against the inertia of the nudger arm 39 to provide additional stack force as well as increased extension of the spring 49. In this embodiment, a periodic pulse force would consistently be applied during the driving of the nudger rollers 37.

Another important factor in the design of the feeding and shingling structure is the minimization of drag. This is accomplished by the rollers 33 in the vertical nudger wall 31, and the rollers 38 which support the bottom edge of the mailpieces 3. The rollers 33 in the nudger wall 31 have their axes oriented vertically and are beveled (not shown) on their lower surface. This prevents mail that is leaning toward the nudger wall 31 from catching under the edge of the rollers 33 as it slides up to vertical. Some of the rollers 38 supporting the bottom edge of the mailpieces 3 have flanges 38*a* on them to prevent mail from getting caught in gaps in the mail path.

Figure 9:
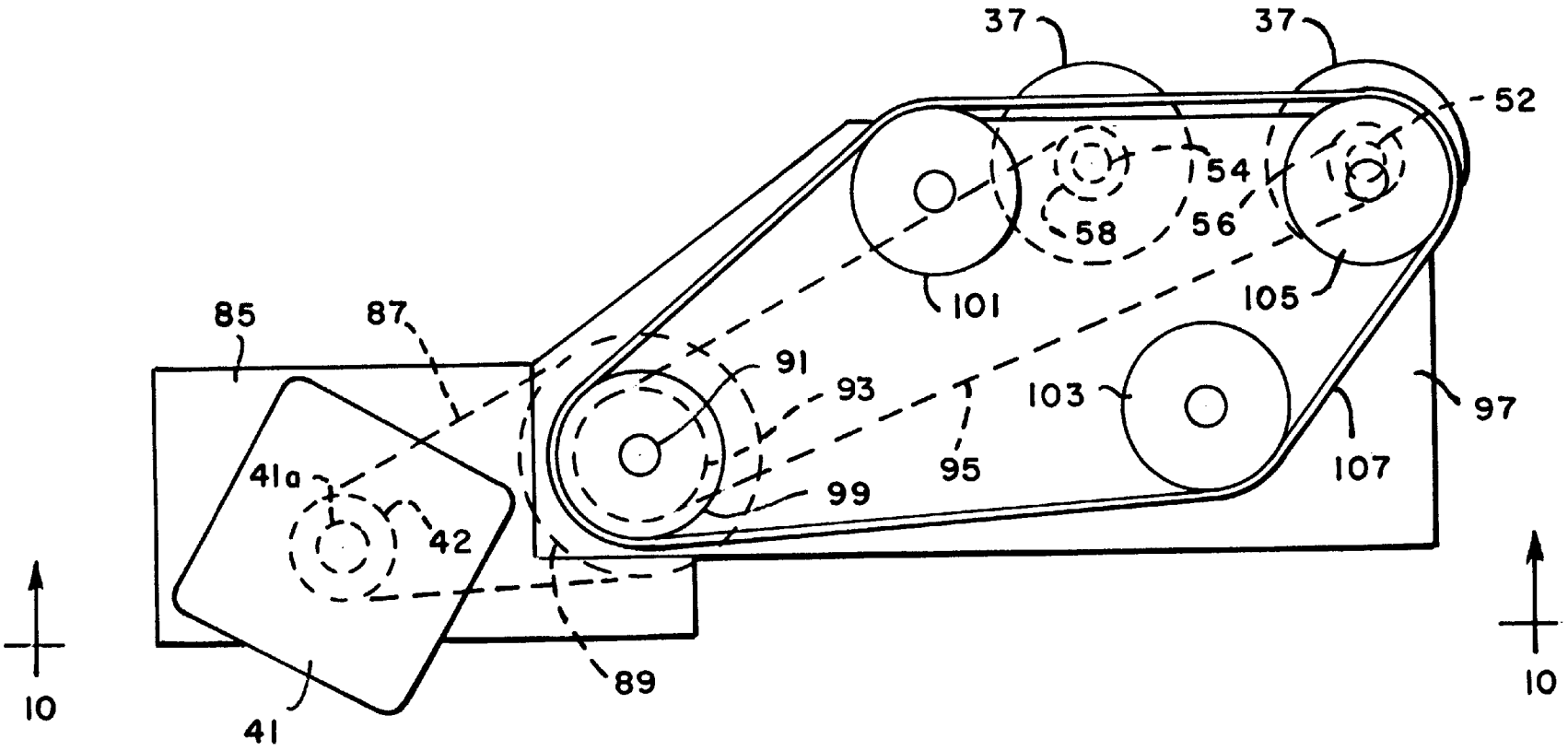
FIG. 9 shows a fifth embodiment including an additional driven belt assembly for feeding large pieces of mail.
Figure 10:
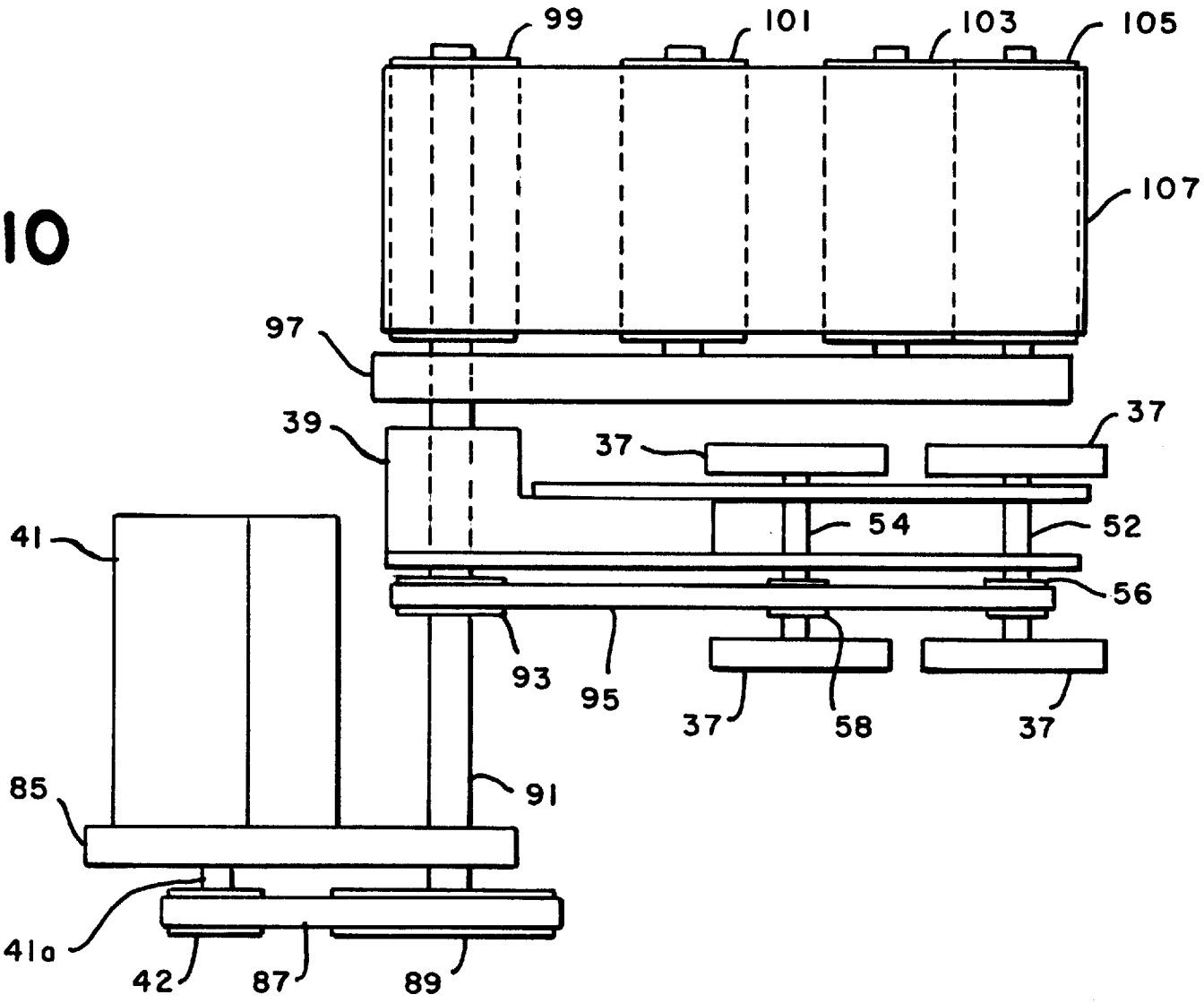
FIG. 10 is a view of FIG. 9 along line 10—10.

In the apparatus of FIG. 1, nudger wall 31 extends above nudger rollers 37 and have idler rollers 33 which reduce friction on large mailpieces that extend above the nudger rollers 37. However, Applicants have found that if the idler rollers extending above the nudger rollers 37 were replaced with a driven belt, the additional feed force provided by the belt assists in moving the large mailpieces toward the separator 45. FIGS. 9 and 10 show the structure for providing such additional feed force. In this embodiment, nudger motor 41 is mounted to a deck 85 and drives pulley 42 into rotation via a shaft 41*a*. A continuous belt 87 is disposed around pulley 42 and a pulley 89 fixedly mounted to a main drive shaft 91 which itself is mounted for rotation in decks 85 and 97. A pulley 93 is fixedly mounted on shaft 91. A second continuous belt 95 is disposed around pulley 93 and nudger pulleys 56, 58 such that as shaft 41*a* is driven by motor 41 the nudger rollers 37 are driven into rotation. Additionally, arm 39 is mounted to be freely rotatable about shaft 91.

Shaft 91 extends above deck 97 and has a first roller 99 fixedly mounted thereon. In addition, idler rollers 101, 103, and 105 are each mounted for rotation about respective shafts extending from deck 97. A continuous belt 107 is disposed around each of the rollers 99, 101, 103, and 105 such that as shaft 91 is driven into rotation belt 107 rotates in the same direction as the nudger rollers 37.

Referring specifically to FIG. 9, the nudger rollers 37 will always extend beyond the belt 107 such that only the leaning portion of the tops of large mailpieces will contact belt 107. Moreover, the sizing of the pulleys in the drive train is such that the belt 107 is driven at a lower or the same velocity as the nudger rollers 37.

Additionally, the mail handling system 1, as shown in FIG. 4, includes a through-beam sensor 81 which projects a beam across opening 40 in the vicinity of nudger rollers 37. As mailpieces enter opening 40, sensor 81 is blocked identifying their presence such that microprocessor 61 operates motor 41 to drive the nudger rollers 37. However, if sensor 81 is not blocked, the nudger rollers 37 are not driven.

Additional advantages and modifications will readily occur to those skilled in the art. Therefore, the invention in its broader aspects is not limited to the specific details, and representative devices, shown and described herein.

Accordingly, various modifications may be made without departing from the spirit or scope of the general inventive concept as defined by the appended claims.

What is claimed is:

1. A nudger for a mail handling system which processes a stack of mixed mail, the nudger comprising:

means for applying a feed force to a lead mailpiece of the stack of mixed mail to feed the lead mailpiece of the stack along a mailpiece feed path, the applying means being moveable between first and second positions;

means for biasing the applying means against a face of the lead mailpiece thereby generating a stack force against the stack of mixed mail;

a stack advance mechanism for moving the stack of mixed mail so that the face of the lead mailpiece contacts the applying means;

wherein at times when the applying means is in the first position the stack advance mechanism moves the stack of mixed mail in the direction of the applying means causing the applying means to move from the first position to the second position against the biasing means such that the stack force increases causing a corresponding increase in the feed force;

wherein at times when the applying means is in the second position the stack advance mechanism stops moving the stack of mixed mail and the applying means continuously feeds mailpieces away from the stack of mixed mail along the mailpiece feed path thereby continuously reducing the size of the stack of mixed mail so that the biasing means gradually moves the applying means from the second position to the first position and the stack force gradually decreases during movement of the applying means from the second position to the first position;

means for determining when mailpieces have stalled in the mailpiece feed path; and means for exerting an additional stack force to the stack of mixed mail in response to the determined stall.

2. A nudger as recited in claim 1, wherein the applying means includes an arm which is moveable between the first and second positions, a plurality of nudger rollers mounted for rotation in the arm, and means for driving the nudger rollers into rotation, end wherein the biasing means is a spring fixed at one end to ground and at the other end to the arm thereby biasing the plurality of nudger rollers against the lead mailpiece, the feed force created by the rotation of the rollers against the lead mailpiece.

3. A nudger as recited in claim 2, further comprising means for controlling the stack advance mechanism and the applying means and means, operatively connected to the controlling means, for sensing the position of the arm and for providing an indication of the sensed position to the controlling means such that the controlling means operates and stops the stack advance mechanism when the arm is respectively in the first and second positions.

4. A nudger as recited in claim 3, wherein the determining means is in communication with the controlling means and at times when the determining means determines that mailpieces have stalled the controlling means operates the stack advance mechanism to move the stack of mixed mail in the direction of the applying means until the arm is moved to a third position where the stack force generated by the spring is greater then the stack force generated by the spring when the arm is in the second position, the additional stack force being the difference between the stack force generated by the spring when the arm is in the third position and the stack force generated by the spring when the arm is in the second position.

5. A nudger as recited in claim 3, wherein the means for exerting on additional stack force includes a solenoid, means for controlling operation of the solenoid, and a spring connected at one end to the applying means and at another end to the solenoid, and wherein upon the determination by the determining means that mailpieces have stalled the controlling means operates the solenoid to change the length of the spring such that the spring provides the additional stack force via the applying means.

6. A nudger as recited in claim 4, further comprising a second spring which only contacts the arm at times when the arm is moved from the second position to the third position, the second spring providing a second additional stack force to the stack of mail.

7. A nudger as recited in claim 2, further comprising an encoder operatively connected to the plurality of nudger rollers and to the drive means, the encoder sending an indication of the rotational position of the nudger rollers to the drive means, and wherein each of the plurality of nudger rollers has a center of gravity displaced from its axis of rotation and the drive means selectively accelerates rotation of the nudger rollers in response to a determination by the determining means that mailpieces have stalled thereby providing the additional stack force.

8. A nudger as recited in claim 2, wherein as the arm moves between the first and second positions it pivots about an arm axis, as the nudger rollers rotate against the face of the lead mailpiece a reaction force is created between the lead mailpiece and the nudger rollers to create a moment about the arm axis, and the arm axis is located relative to the reaction force so that as the nudger rollers move with the arm from the second to the first position the moment increases pulling the arm toward the stack of mixed mail to increase the stack force.

* * * * *